US006551457B2

(12) United States Patent
Westman et al.

(10) Patent No.: US 6,551,457 B2
(45) Date of Patent: Apr. 22, 2003

(54) PROCESS FOR THE PRODUCTION OF PAPER

(75) Inventors: Caroline Westman, Gothenburg (SE); Tom Lindstrom, Sollentuna (SE); Janne Laine, Esbo (FI); Maria Norell, Hovas (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/957,351

(22) Filed: Sep. 20, 2001

(65) Prior Publication Data

US 2002/0062938 A1 May 30, 2002

(30) Foreign Application Priority Data

Sep. 20, 2000 (EP) ..... 00850149

(51) Int. Cl.[7] ..... D21H 23/28; D21H 17/74; D21H 21/52

(52) U.S. Cl. ..... 162/158; 162/168.3; 162/164.1; 162/175; 162/178; 162/181.2; 162/181.4; 162/181.8; 162/206

(58) Field of Search ..... 162/158, 168.3, 162/168.1, 164.1, 164.6, 175, 181.1, 181.2, 181.4–181.8, 204–207, 178; 34/397–400, 419, 423–426, 442, 446

(56) References Cited

U.S. PATENT DOCUMENTS

| | | | | | |
|---|---|---|---|---|---|
| 4,324,613 | A | * | 4/1982 | Wahren | 162/111 |
| 4,388,150 | A | | 6/1983 | Sunden et al. | 162/175 |
| 4,643,801 | A | | 2/1987 | Johnson | 162/164.1 |
| 4,753,710 | A | | 6/1988 | Langley et al. | 162/164.3 |
| 4,795,531 | A | | 1/1989 | Sofia et al. | 162/164.6 |
| 4,927,498 | A | | 5/1990 | Rushmere | 162/168.3 |
| 4,954,220 | A | | 9/1990 | Rushmere | 162/168.3 |
| 4,961,825 | A | | 10/1990 | Andersson et al. | 162/175 |
| 4,980,025 | A | | 12/1990 | Andersson et al. | 162/168.3 |
| 5,071,512 | A | | 12/1991 | Bixler et al. | 162/175 |
| 5,127,994 | A | | 7/1992 | Johansson | 162/168.3 |
| 5,176,891 | A | | 1/1993 | Rushmere | 423/328.1 |
| 5,277,762 | A | | 1/1994 | Felegi, Jr. et al. | 162/145 |
| 5,368,833 | A | | 11/1994 | Johansson et al. | 423/338 |
| 5,404,654 | A | | 4/1995 | Babinsky et al. | 34/122 |
| 5,439,559 | A | * | 8/1995 | Crouse | 162/358.5 |
| 5,447,604 | A | | 9/1995 | Johansson et al. | 162/181.6 |
| 5,470,435 | A | | 11/1995 | Rushmere et al. | 162/181.6 |
| 5,543,014 | A | | 8/1996 | Rushmere et al. | 162/181.6 |
| 5,571,494 | A | | 11/1996 | Saastamoinen | 423/338 |
| 5,573,674 | A | | 11/1996 | Lind et al. | 210/702 |
| 5,584,966 | A | | 12/1996 | Moffett | 162/168.1 |
| 5,603,805 | A | | 2/1997 | Andersson et al. | 162/168.3 |
| 5,607,552 | A | | 3/1997 | Andersson et al. | 162/181.6 |
| 5,688,482 | A | | 11/1997 | Saastamoinen | 423/335 |
| 5,707,493 | A | | 1/1998 | Saastamoinen | 162/164.1 |
| 5,808,053 | A | | 9/1998 | Johansson et al. | 536/124 |
| 6,049,998 | A | * | 4/2000 | Crouse et al. | 34/445 |
| 6,100,322 | A | | 8/2000 | Persson et al. | 524/418 |
| 6,270,627 | B1 | | 8/2001 | Keiser et al. | 162/181.6 |

FOREIGN PATENT DOCUMENTS

| | | | |
|---|---|---|---|
| EP | 235 893 | 9/1987 | D21D/3/00 |
| EP | 335 575 | 10/1989 | D21D/3/00 |
| EP | 723 612 | 7/1996 | D21F/3/02 |
| EP | 742 312 | 11/1996 | D21F/3/02 |
| EP | 796 945 | 9/1997 | D21F/3/02 |
| EP | 824 157 | 2/1998 | D21F/1/02 |
| GB | 664239 | 1/1952 | |
| WO | WO 97/18351 | 5/1997 | D21H/17/45 |
| WO | WO 99/16972 | 4/1999 | D21H/17/68 |
| WO | WO 99/34055 | 7/1999 | D21F/11/00 |
| WO | WO 99/36620 | 7/1999 | D21H/21/18 |
| WO | WO 99/55962 | 11/1999 | |
| WO | WO 99/55964 | 11/1999 | D21H/23/04 |
| WO | WO 99/55965 | 11/1999 | D21H/23/08 |

OTHER PUBLICATIONS

J. Phys. Chem. 60 (1956) "Degree of Hydration of Particles of Colloidal Silica in Aqueous Solution", Iler & Dalton, pp. 955–957.

Analytical Chemistry vol. 28, No. 12, (1956), "Determination of Specific Surface Area of Colloidal Silica by Titration with Sodium Hydroxide", George W. Sears, Jr., pp. 1981–1983.

* cited by examiner

*Primary Examiner*—Jose A. Fortuna
(74) *Attorney, Agent, or Firm*—Lainie E. Parker

(57) ABSTRACT

A process for the production of paper from an aqueous suspension containing cellulosic fibers, and optional fillers, which comprises draining the suspension to obtain a paper web and subjecting the obtained paper web to impulse pressing by passage through at least one press nip having at least one heated roll which is in contact with the web and heated to a temperature above 100° C., wherein a chemical system comprising a polymer component and micro- or nanoparticles are added to the suspension or the paper web before the paper web passes the press nip of the impulse unit.

30 Claims, No Drawings

PROCESS FOR THE PRODUCTION OF PAPER

The present invention relates to paper making and more specifically to a process for the production of paper wherein a web of paper is formed, dewatered and then dried by means of impulse pressing (drying) in the press section at temperatures above the boiling point of water. In the process, a chemical system comprising at least one polymer component in combination with micro- or nanoparticles are added to the furnish or paper web before passing an impulse unit. By the use of the process according to the invention delamination of the paper web can be avoided and the tendency of adhesion to the press roll and formation of deposits on the roll is removed or decreased. By means of the process according to this invention paper with improved physical properties, such as densification of the outer layer, high smoothness and increased strength can be produced.

BACKGROUND

In the paper making art, an aqueous suspension containing cellulosic fibers, fillers and additives, referred to as the stock, is fed into a headbox which ejects the stock onto a forming wire. Water is drained from the stock through the forming wire so that a wet web of paper is formed on the wire and the web is further dewatered in the press section and dried in the drying section of the paper machine. Water obtained by dewatering the stock, referred to as the white water, which usually contains fine particles, i.e. fine fibers, fillers and additives, is usually recirculated in the paper making process. Drainage and retention aids are conventionally introduced into the stock in order to facilitate drainage and increase adsorption of fine particles onto the cellulosic fibers so that they are retained with the fibers on the wire.

In order to increase the productivity in paper production a proposed solution has been to increase the speed of the web through the paper machine. However, increasing the speed at which the paper web is produced creates problems in the dry section of the paper making process. Thus, as the web speed increases, heat transfer to the dry paper web from each drying cylinder decreases. To solve the heat transfer problem the dry section of paper making machines must be made longer. Another solution of said problem is to use an impulse press. An impulse press employs a high temperature roll which is heated above 100° C. In impulse pressing, or impulse drying, the paper web after being formed is passed through a number of roll pairs, the rolls usually unheated, to remove water by mechanical pressing and is then contacted by the heated roll to remove water by evaporation in the heated press nip. The heated roll can be of a temperature of, for example, from 100 to 400° C. An endless porous felt is usually located in the nip and passes around the unheated roll. The combination of heat and pressure exerted on the web by the nips of the rolls substantially increases the dry solids contents. However, it has been noted that impulse pressing usually has the undesirable effect of delaminating the web.

The potential of the impulse pressing technology has been very limited owing to this delamination problem and this has reduced or prevented the industrial use of this technology.

Different solutions have been proposed in order to solve the problem with web delamination after the web leaves the nip. Several solutions deal with the design and construction of the pair of rolls used in impulse drying. Thus, European Patent Application No. 0 723 612 relates to an impulse dryer roll with a shell of high thermal diffusivity in order to improve the heat transfer to the paper web being dried. The U.S. Pat. No. 5,404,654 relates to a paper web impulse drying apparatus wherein web delamination is prevented by both (a) a steam chamber on the exit side of the nip through which the web passes, and (b) heating the web prior to its entrance into the nip. European Patent Application No. 0 742 312 relates to a method and apparatus for drying a wet fiber web by impulse drying and then introducing the web into a gas pressurized zone followed by reducing the pressure in the zone wherein the reduction preferably is effected with cooling of the fiber web.

International Patent Application Publication No. WO 99/36620 relates to an impulse dried paper having a three-dimensional pattern of alternating raised and recessed portions which is conveyed to the paper in connection with impulse drying. The object of the invention described in said publication is to provide a method of producing an impulse dried paper having a three-dimensional pattern where the paper has a high bulk and a high absorption capacity and where the three-dimensional structure should be maintained in dry as well as in wet condition. Said object is stated to be achieved by the fact that the paper contains at least 0.05% by weight, based on the dry fiber weight, preferably at least 0.25% by weight, of one or more additives which in connection with impulse drying undergoes a chemical reaction, so that they contribute in stabilizing the pattern structure that has been conveyed to the paper at the impulse drying. The additives proposed are reactive polymers, such as wet strength agents, fixing agents, polysaccharides, polyvinyl alcohol or a polyacid such as polyacrylic acid and copolymers thereof. This publication does not at all deal with or even mention the delamination problem in connection with impulse drying.

In addition to delamination of the paper web, other undesirable effects observed in impulse drying include adhesion of the sheet to the press roll and occurrance of deposits on the roll.

THE INVENTION

According to the present invention it has unexpectedly been found that the problems with delamination of the paper web and the tendency of adhesion to the press roll and forming of deposits on the roll can be removed or substantially decreased by addition of a chemical additive system containing micro- or nanoparticles. More specifically, the present invention relates to a process for the production of paper from an aqueous suspension containing cellulosic fibres, and optional fillers, which comprises draining the suspension to obtain a paper web and subjecting the paper web to impulse pressing, or impulse drying, by passage through at least one press nip having at least one heated roll which is in contact with the web and heated to a temperature above 100° C., wherein a polymer component and micro- or nanoparticles are added to the suspension or the paper web before the paper web passes the press nip of the impulse unit. The polymer component and micro- or nanoparticles are also referred to herein as chemical system, or micro- or nanoparticle system. The invention thus relates to a process as further defined in the appended claims.

The micro- or nanoparticle system according to the present invention can be used alone or in combination with wet strength agents as well as sizing agents. The chemicals are added to the suspension, furnish or paper web before the web passes the impulse unit. The chemicals can be added at any position in the wet end before draining the suspension, such as, for example, the pulp chest, machine chest, constant level box, fan pumps, screen, etc., and the chemicals can be added before or after these steps as well as during them. They can also be added to the dilution flow of a dilution headbox or in one or several layers of a multilayering headbox. It is also possible to apply them wet-in-wet within a headbox by using a method and a device similar to that described in the European Patent Application No. EP 0 824 157. These differentiated additions in the headbox can be used for z-layered additions.

A micro- or nanoparticle system refers to a chemical system comprising a polymer component and micro- or nanoparticles, preferably an anionic microparticulate material. The polymer component can be selected from anionic, amphoteric, non-ionic and cationic organic polymers and mixtures thereof. The use of such polymers is known in the art. The polymers can be derived from natural or synthetic sources, and they can be linear, branched or cross-linked. Preferably the polymer is water-soluble or water-dispersible. Examples of generally suitable organic polymers include anionic, amphoteric and cationic polysaccharides, e.g. starches, guar gums, celluloses, chitins, chitosans, glycans, galactans, glucans, xanthan gums, pectins, mannans, dextrins, preferably starches and guar gums, suitable starches including potato, corn, wheat, tapioca, rice, waxy maize etc.; anionic, amphoteric and cationic synthetic organic polymers, e.g. vinyl addition polymers such as acrylate- and acrylamine-based polymers, as well as cationic poly(diallyidimethyl ammonium chloride), cationic polyethylene imines, cationic polyamines, polyamidoamines and vinylamide-based polymers, melamine-formaldehyde and urea-formaldehyde resins. Suitably the polymer component according to the invention comprises at least one cationic or amphoteric polymer, preferably cationic polymer. Cationic starches, cationic acrylamide-based polymers and cationic acrylamine-based polymers are particularly preferred polymer components and they can be used singly, together with each other or together with other polymers, e.g. other cationic polymers or anionic acrylamide-based polymers. Examples of suitable polymers that can be used according to the present invention include those described in U.S. Pat. Nos. 5,277,762; 5,808,053; and 6,100,322, and International Patent Application Publication No. WO 97/18351, which are hereby incorporated herein by reference.

According to a preferred embodiment of the present invention, the polymer component comprises an organic polymer having a hydrophobic group, suitably an anionic or cationic polymer of this type and preferably cationic starch or cationic acrylamide-based polymer. Examples of suitable hydrophobic groups include aromatic groups and non-aromatic hydrophobic groups. The hydrophobic group of the polymer can be present in the polymer backbone but preferably it is present in a pendent group that is attached to or extending from the polymer backbone (main chain). Examples of suitable aromatic groups and groups comprising an aromatic group include aryl and aralkyl groups, e.g. phenyl, phenylene, naphthyl, xylylene, benzyl and phenylethyl; nitrogen-containing aromatic (aryl) groups, e.g. pyridinium and quinolinium, as well as derivatives of these groups. Examples of suitable non-aromatic hydrophobic groups include aliphatic hydrocarbon groups like terminal alkyl groups having at least 3 carbon atoms, suitably from 3 to 12 and preferably from 4 to 8 carbon atoms, including linear, branched and cyclic alkyl groups. Organic polymers having a hydrophobic group can be prepared in many ways known in the art, for example by polymerizing a monomer mixture containing at least one monomer having a hydrophobic group. Examples of suitable polymers having a hydrophobic group that can be used as the polymer component according to the present invention include those described in International Patent Application Publication Nos. WO 99/55965, WO 99/55962 and WO 99/55964, which are hereby incorporated herein by reference.

The molecular weight of the polymer is usually above 200,000, suitably above 300,000. preferably at least 500,000 and most preferably at least 1,000,000. The upper limit is not critical but usually the molecular weight for synthetic polymers is below about 30,000,000, suitably below 20,000,000. For polymers derived from natural sources the molecular weight can be substantially higher.

According to another preferred embodiment of the present invention, the polymer component comprises a high molecular weight (hereinafter HMW) organic polymer, suitably at least one polymer as described above, and at least one low molecular weight (hereinafter LMW) cationic organic polymer, commonly referred to and used as an anionic trash catcher (ATC). Such LMW cationic organic polymers are known in the art as neutralizing and/or fixing agents for detrimental anionic substances present in the stock, commonly referred to as anionic trash catchers. The LMW cationic organic polymer can be derived from natural or synthetic sources, and preferably it is an LMW synthetic polymer. Suitable organic polymers of this type include LMW highly charged cationic organic polymers such as polyamines, polyamideamines, polyethyleneimines, homo- och copolymers based on diallyldimethyl ammonium chloride, (meth)acrylamides and (meth)acrylates. In relation to the molecular weight of the HMW polymer, the molecular weight of the LMW cationic organic polymer is preferably lower; it is suitably at least 1,000 and preferably at least 10,000. The upper limit of the molecular weight is usually about 700,000, suitably about 500,000 and usually about 200,000. The LMW cationic organic polymer preferably has a higher cationicity and/or higher cationic charge density than the HMW polymer.

Preferred polymer components comprising an LMW cationic organic polymer and HMW polymer according to the present invention include LMW cationic organic polymer in combination with HMW polymer(s) selected from cationic starch, cationic acrylamide-based polymer, anionic acrylamide-based polymer and combinations thereof.

The micro- or nanoparticles of the chemical system used according to the present invention are preferably anionic micro- or nanoparticulate materials, for example anionic inorganic and organic particles. Anionic inorganic particles that can be used according to the invention include anionic silica-based particles and clays of smectite type.

The anionic inorganic particles are suitably in the colloidal range of particle size. Anionic silica-based particles, i.e. particles based on anionic inorganic condensation polymers of $SiO_2$ or silicic acid, are preferably used and such particles are usually supplied in the form of aqueous colloidal dispersions, so called sols. Examples of suitable silica-based particles include colloidal silica and different types of polysilic acid. The silica-based sols can also be modified and contain other elements, e.g. aluminum and/or boron, which can be present in the aqueous phase and/or in the silica based particles. Suitable silica-based particles of this type include aluminum-modified silica and aluminum silicates. Mixtures of silica-based particles can also be used. The anionic silica based particles usually have an average particle size below about 50 nm, preferably below about 20 nm and more preferably in the range from about 1 nm to 10 nm. As conventional in silica chemistry the particle size refers to the average size of the primary particles, which may be aggregated or non-aggregated. The specific surface area of the silica-based particles is suitably above 50 $m^2/g$ and preferably above 100 $m^2/g$. Generally, the specific surface area can be up to about 1700 $m^2/g$ and preferably up to 1000 $m^2/g$. The specific surface area can be measured by means of titration with NaOH in known manner, e.g. as described by Sears in Analytical Chemistry 28(1956):12, 1981–1983 and in U.S. Pat. No. 5,176,891. The given area thus represents the average specific surface area of the particles.

The silica-based particles can be e.g. colloidal silica or aluminum-modified silica having a specific surface area within the range of from 50 to 1500 $m^2/g$ and preferably from 100 to 950 $m^2/g$.

Preferably, the silica-based particles are present in a sol having an S-value in the range of from 8 to 45%, preferably from 10 to 30%. The S-value can be measured and calculated as described by Iler & Dalton in J. Phys. Chem. 60(1956), 955–957. The S-value indicates the degree of aggregate or microgel formation and a lower S-value is indicative of a higher degree of aggregation.

Suitable anionic silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; 5,707,493; and 6,270,627; which are hereby incorporated herein by reference.

Clays of smectite type which can be used in the process according to the present invention include naturally occurring, synthetic and chemically treated materials and include montmorillonite/bentonite, hectorite, beidelite, nontronite and saponite. A suitable material is bentonite and especially bentonite which after swelling has a surface area within the range of from 400 to 800 $m^2/g$. Suitable clays for use according to the present invention include those disclosed in U.S. Pat. Nos. 4,753,710; 5,071,512; and 5,607,552, which are hereby incorporated herein by reference.

Anionic organic particles which can be used in the process according to the invention include cross-linked anionic vinyl addition polymers, suitably copolymers comprising an anionic monomer, such as acrylic acid, methacrylic acid and sulfonated or phosphonated vinyl addition monomers, usually copolymerized with nonionic monomers like, (meth) acrylamide, alkyl(meth)acrylates, etc. Other useful anionic organic particles include anionic condensation polymers, e.g. melamine-sulfonic acid sols.

The micro- or nanoparticles which can be used according to the present invention can also be selected from amphoteric aluminum hydroxide and polyaluminum salts alone or included in combinations.

Suitable dosages, expressed in kg per tonne (kg/t) based on dry pulp and optional filler, of the components in the micro or nanoparticle system are 0.1–50 kg/t polysaccharide, preferably 0.1–30 kg/t and most preferably 1–10 kg/t; 0.01–15 kg/t synthetic organic polymer, preferably 0.01–10 kg/t and most preferably 0.1–2 kg/t; 0.01–10 kg/t anionic silica-based particles, preferably 0.01–5 kg/t and most preferably 0.05–2 kg/t; 0.01–10 kg/t anionic organic micro- or nanoparticles, preferably 0.01–10 kg/t and most preferably 0.05–5 kg/t; 0.01–25 kg/t anionic swelling clay, preferably 0.01–15 kg/t and most preferably 0.5–6 kg/t; at least 0.001 kg/t aluminum hydroxide or polyaluminum salts, preferably 0.01–5 kg/t and most preferably 0.05–1 kg/t, calculated as $Al_2O_3$ based on dry pulp and optional filler.

The chemicals according to the present invention can be added to the aqueous cellulosic suspension, or stock, in conventional manner and in any order. It is usually preferable to add the polymer component to the stock before adding the micro- or nanoparticulate material, even if the opposite order of addition may be used. It is further preferred to add the polymer component before a shear stage, which can be selected from pumping, mixing, cleaning, etc., and to add the micro- or nanoparticulate material after that shear stage. When an LMW cationic organic polymer is comprised in the polymer component, it is usually preferable to introduce the LMW cationic organic polymer into the stock prior to introducing an HMW polymer and micro- or nanoparticulate material.

By combining the micro- or nanoparticle systems according to the invention with wet strength agents and sizing agents further improvement of the Scott Bond-values can be obtained.

Examples of suitable wet strength resins which can be used are polyamide-amine-epichlorohydrin resin (PAAE), urea-formaldehyde resin (UF) and melamine-formaldehyde resin (MF) and glyoxal-polyacrylamide (PAM). Suitable dosages, expressed in kg per tonne (kg/t) based on dry pulp and optional filler, of wet strength agents can be 0.02–30 kg/t, preferably 0.02–15 kg/t and most preferably 1.5–10 kg/t.

Examples of suitable sizing agents that can be used are alkyl ketene dimers (AKD), alkenyl succinic acid anhydrides (ASA) and rosin size. The sizing agents can be used in the following dosages, expressed in kg per tonne (kg/t) based on dry pulp and optional filler: 0.2–4 kg/t AKD, preferably 1–2 kg/t; 0.2–5 kg/t ASA, preferably 1–2 kg/t; 0.5–10 kg/t rosin size, preferably 2–5 kg/t.

When using the sizing agents pH values should suitably be controlled within the range 4–9, preferably 5–9.

Further additives that are conventional in papermaking can of course be used in combination with the chemicals according to the invention, such as, for example, additional dry strength agents, optical brightening agents, dyes, aluminium compounds, etc. Examples of suitable aluminium compounds include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate sulphates, and mixtures thereof. The polyaluminium compounds may also contain other anions than chloride ions, for example anions from sulfuric acid, phosphoric acid, organic acids such as citric acid and oxalic acid. When employing an aluminium compound in the present process, it is usually preferable to add it to the stock prior to the polymer component and micro- or nanoparticulate material.

The aqueous cellulosic suspension may contain mineral fillers of conventional types such as, for example, kaolin, china clay, titanium dioxide, gypsum, talc and natural and synthetic calcium carbonates such as chalk, ground marble and precipitated calcium carbonate.

The process of this invention is used for the production of paper. The term "paper", as used herein, of course include not only paper and the production thereof, but also other web-like products, such as for example board and paperboard, and the production thereof. The invention is particularly useful in the manufacture of paper having grammages below 150 $g/m^2$, preferably below 100 $g/m^2$, for example fine paper, newspaper, light weight coated paper, super calendered paper and tissue. The process can be used in the production of paper from different types of suspensions of cellulose-containing fibres and the suspensions should suitably contain at least 25% by weight and preferably at least 50% of weight of such fibres, based on dry substance. The suspensions can be based on fibres from chemical pulp such as sulphate, sulphite and organosolv pulps, wood-containing or mechanical pulp such as thermomechanical pulp, chemo-thermomechanical pulp, refiner pulp and groundwood pulp, from both hardwood and softwood, and can also be based on recycled fibres, optionally from de-inked pulps, and mixtures thereof. The invention is particularly useful in the manufacture of paper from suspensions based on wood-containing pulps like thermomechanical pulps.

Impulse pressing according to the present invention can be carried out as generally described above. More specifically, the present process comprises passing a wet web of paper, which contains the chemicals described above and which is formed in a papermaking process, through at least one press nip containing at least one heated roll, herein also referred to as a heated press nip. Preferably, before passage through the heated press nip, the wet web of paper obtained by draining the suspension is subjected to dewatering by mechanical pressing. The heated press nip may be constructed in several different ways. For example, heated press nip can contain a pair of rolls or a roll and a shoe. Preferably, when passing the press nip, at least one surface of the paper web is contacted with a heated roll and both surfaces of the paper web are exposed to pressure. The heated press nip may be positioned directly after the wire couch or after one or more unheated press nips. After passage through the heated press nip of the impulse pressing unit, the paper web is preferably further dried in a drying section of the paper machine. Suitably, after forming the paper web at the forming table the wet web is carried into a press nip by a wet absorbing felt. The roll in contact with the web is heated to a high temperature above 100° C., preferably from 150 to 400° C. and particularly from 200 to 350° C. The temperature of the heated roll can vary depending on such factors as moisture content of the web, thickness of the web, the contact time between the roll and the web and the desired moisture content of the treated paper web.

The impulse pressing according to the invention preferably provides both mechanical pressing and evaporation of water from the paper web. When the paper web enters the heated press nip of the impulse pressing unit, i.e. prior to being contacted with the heated roll, the paper web can have a dry (solids) content of at least 20%, suitably at least 25% and usually at least 30%; the dry solids content of the paper web can be up to 90%, suitably up to 70% and preferably up to 50%; and usually the dry solids content of the paper web is within the range of from 30 to 45%. Preferably the process produces a paper web having a substantially higher dry solids content; passage through the heated press nip according to the invention normally increases the dry solids content of the paper web by at least 10% (for example, the dry solids content may increase from 40% to at least 44%), suitably at least 25% (for example, from 40% to at least 50%) and preferably at least 50% (for example, from 40% to at least 60%).

One way of heating the roll is by heating it inductively by using a magnetic field. The number of impulse units may also vary but usually one nip is used or two nips following each other.

According to a preferred embodiment of the present invention, the paper web is passed through two or more heated press nips in which each heated press nip contains at least one heated roll. In processes employing two or more heated press nips it is usually advantageous to bring both surfaces of the paper web into contact with at least one such heated roll. Paper webs so treated usually show less curl and less two-sidedness. It is also possible to employ two or more heated rolls having different temperatures. Various temperature profiles may be employed. For instance, it is possible to employ initial and subsequent heated rolls, the initial heated roll(s) having a temperature that is higher than the temperature of the subsequent heated roll(s). However, it is also possible to employ initial and subsequent heated rolls, the initial heated roll(s) having a temperature that is lower than the temperature of the subsequent heated roll(s). The temperatures of such two or more heated rolls are preferably within the ranges described above. When the paper web enters the initial heated press nip of a multi heated press nip equipped paper machine, the paper web usually has a dry solids content of within the range of from 20 to 50%, and suitably within the range of from 30 to 45%. In processes employing two or more heated press nips the increase in dry solids content of the paper web may differ from one heated press nip to another. Each passage through a heated press nip usually increases the dry solids content of the paper web as described above although variations may occur.

In processes according to the invention which comprises passing the paper web through two or more impulse pressing (drying) units, thereby passing the paper web through two or more heated press nips and bringing it in contact with two or more heated rolls, preferably more than two heated press nips and rolls, it is possible to employ a paper machine with a much smaller subsequent drying section, or to dispense with a subsequent conventional drying section. According to a preferred embodiment of this invention employing two or more heated press nips, the paper web is passed through one heated press nips at a dry solids content within the range of from 70% to 90%. Such a heated press nip can be part of breaker stacks of a paper machine and the passage through such a heated press nip may result in a smaller increase in dry solids content of the paper web than described above.

In addition to the advantages described above, density, tensile strength, surface strength and smoothness are other paper properties which may be positively affected by the process according to the present invention.

The invention is further illustrated by means of the following examples which, however, are not intended to limit the scope thereof. Parts and % relate to parts by weight and % by weight, respectively, unless otherwise stated.

EXAMPLE 1

Paper making with impulse pressing was investigated on a laboratory scale. A 60 g/m$^2$ paper, based on bleached sulphate pulp with Schopper-Riegler number (SR) 29, was pressed in a laboratory shoe press with a heating equipment. A paper sheet was prepared according to the present invention in which the following chemicals were added to the aqueous cellulosic suspension prior to dewatering: cationic polyacrylamide (Eka PL 1310, available from Eka Chemicals) added in an amount of 0.5 kg/t, based on dry pulp, and anionic silica-based particles (Eka NP 780, available from Eka Chemicals) added in an amount of 0.5 kg/t, based on dry pulp. As a reference a sheet was prepared without these chemicals. The temperature was varied between 25–350° C. while the pressure and the press time were kept constant at 2 MPa and 12 ms respectively. The internal bond strength, Scott Bond, was measured on both the reference sheets and the sheets prepared according to the present invention.

The following Table 1 shows how Scott Bond values change with temperature for sheets containing the chemical system used according to the present invention and for reference sheets without these chemicals. For the sheets without chemicals it can be seen that Scott Bond values increase at first but then decrease at temperatures higher then 200° C. Initial increases are caused by the fact that pressing of the sheet at higher temperature increases the dry content in the sheet and therefore increases the density of the sheet and also the Scott Bond value. At a critical temperature the sheet starts to delaminate and Scott Bond values decrease with higher temperature. However, for sample sheets prepared according to the present invention which contained polyacrylamide and silica-based particles a different behavior could be seen and Scott Bond values increased in the whole temperature interval. Consequently the addition of the chemical system in accordance with the teaching of the present invention prevented delamination.

TABLE 1

| Temperature [° C.] | Scott Bond [J/m$^2$] no chemicals added | Scott Bond [J/m$^2$] Chemical system of 0.5 kg/t cationic polyacrylamide and 0.5 kg/t anionic silica-based particles added |
|---|---|---|
| 25 | 255 | 370 |
| 100 | 278 | 383 |
| 150 | 323 | 418 |
| 200 | 325 | 415 |
| 225 | 323 | 421 |
| 250 | 319 | 425 |
| 275 | 309 | 455 |
| 300 | 299 | 465 |
| 350 | 270 | 477 |

EXAMPLE 2

Paper making with impulse pressing was carried out on a laboratory scale. Paper of basis weight 100 g/m$^2$ was produced in a dynamic sheet former (DSF), supplied by FiberTech. The furnish used contained 70% bleached sulphate pulp and 30% filler and the pulp was refined to a freeness value of 200 CSF. The fibre mix consisted of 60% hardwood and 40% softwood and chalk was added as filler. The reference sheets were made without any added chemicals or with only one component of the chemical system used in the process according to the present invention while the sheets prepared according to the present invention were prepared by the use of a chemical system consisting of a polymer component in combination with nano-particles. Furthermore, sheets were also prepared according to the present invention to which an addition to the chemical system of a polymer component and nanoparticles also a wet strength agent or a sizing agent had been added.

The different chemicals were added to the furnish after a certain delay time. The following chemical additions were made, based on dry cellulosic pulp and filler: 8 kg/t cationic starch (Raisamyl RS 142, available from Raisio); 8 kg/t cationic starch (RS 142) in combination with 1 kg/t colloidal silica (Eka NP 780); 8 kg/t cationic starch (RS 142) and 1 kg/t colloidal silica (Eka NP 780) in combination with 3 kg/t polyamideamine-epichlorohydrin resin (PAAE) wet strength agent (Kenores 1440, available from Eka Chemicals); and 8 kg/t cationic starch (RS 142) and 1 kg/t colloidal silica (Eka NP 780) in combination with 1.2 kg/t alkyl ketene dimer (AKD) sizing agent (Keydime 222, available from Eka Chemicals).

Stirring of the drum started and after creating a water film a furnish sample of 4.4 g/l was added into the DSF. The starch was added after 45 s from adding the furnish and the colloidal silica was added after 75 s from adding the furnish. The wet strength agent, when used, was added 15 s after addition of the furnish while the sizing agent, when used, was added immediately after the addition of furnish. Dewatering was carried out 5 s after addition of the colloidal silica. All the sheets were pressed at 5 bar after forming the sheet. Then the sheets were pressed in a laboratory shoe press with heating equipment (the same as in Example 1). Pressure and press time were kept constant at 2 MPa and 12 ms respectively for all sheets. After pressing the sheets were dried in a restrained dryer and before measuring paper properties the sheets were conditioned in a climate room at 23° C. and 50% RH according to SIS SS-EN 20187.

For the reference samples created in the DSF without any added chemicals the temperature in the shoe press varied between 200–300° C. and Scott Bond values were measured. The results are shown in the following Table 2 from which it can be seen that the Scott Bond values decrease as the temperature is raised. This decrease is due to delamination in the sheet.

TABLE 2

| Temperature [° C.] | Scott Bond [J/m$^2$] No chemicals added |
|---|---|
| 200 | 173 |
| 250 | 167 |
| 300 | 78 |

Tests were carried out with a) reference sheets made without any added chemicals, b) sheets made with starch as added chemical, c) sheets prepared according to the present invention by the addition of a chemical system of an organic polymer together with nanoparticles and d) sheets prepared according to the present invention to which in addition to the chemical system of a polymer component and nanoparticles also a wet strength agent or a sizing agent has been added. The temperature in the shoe press was kept at 250° C. to see if sticky deposits were formed on the rolls and how strength in the z-direction was affected. The results obtained are shown in the following Table 3.

TABLE 3

| Added chemicals | Scott Bond [J/m$^2$] | Sticky deposits |
|---|---|---|
| No chemicals | 167 | no |
| Starch | 363 | yes |
| Cationic starch and colloidal silica | 376 | no |
| Cationic starch and colloidal silica + PAAE | >525 | no |
| Catinic starch and colloidal silica + AKD | 441 | no |

From the results in Table 3 it can be seen that the Scott Bond values increase when using the chemical system prescribed according to the present invention consisting of a polymer component (starch) in combination with nanoparticles (colloidal silica) both as compared to the sheets without added chemicals and sheets to which only starch has been added. Furthermore, deposits are formed when only starch is used. From the Table it can also be seen that the Scott Bond values are even further improved when in addition to the chemical system of a polymer component and nanoparticles a wet strength agent or a sizing agent is added.

EXAMPLE 3

Bleached sulphate pulp of a mixture of 50% softwood and 50% hardwood was used for a trial on a pilot paper machine.

Refining was carried out to SR 25. $CaCO_3$ was used as a filler in a level of 15%, based on dry pulp.

The configuration of the paper machine was a roll-blade-forming unit to simulate industrial forming. The first press was a conventional double felted press with a line load of 60 kN/m. The second and third presses were extended nip presses. The second press was double felted and had a line load of 500 kN/m. The third press was single felted and had a line load of 700 kN/m. It was heated with an induction heater from 200° C. with a stepwise increase of +10° C. up to 270° C. The machine speed was 600 m/min and the basis weight produced was 60 g/m$^2$.

A reference series was run without chemicals. Three different sample series were run with chemicals added to the furnish. One with 1 kg/t of cationic polyacrylamide (Percol 292) added to the furnish; one with 5 kg/t of starch (RS 142); one with 20 kg/t of starch (RS 142) in combination with 2.5 kg/t silica-based particles (Eka NP 780). The temperature was varied and the Scott Bond values were measured for all sheets. The results are shown in Table 4.

TABLE 4

| Temperature | Scott Bond [J/m$^2$] | Scott Bond [J/m$^2$]; chemicals added | | |
|---|---|---|---|---|
| [° C.] | no chemicals | C-PAM | Starch | Starch + Silica I |
| 200 | 342 | 370 | 345 | 540 |
| 210 | 370 | 404 | 377 | 545 |
| 220 | 343 | 391 | 360 | 515 |
| 230 | 323 | 396 | 360 | 515 |
| 240 | 289 | 358 | 373 | 519 |
| 250 | 239 | 347 | 340 | |
| 260 | 185 | 334 | 294 | |
| 270 | 176 | 303 | | |

The results obtained show that the critical delamination temperature, the temperature where the Scott Bond value starts to decrease, can be increased by adding the chemical system according to the present invention, which makes it possible to press the sheets at higher temperature while still avoiding delamination of the sheets.

EXAMPLE 4

Delamination can be discovered visually as bubbles on the surface of the sheet when the sheet is still wet. A visual comparison was carried out for sheets produced without chemicals and sheets where polyacrylamide and colloidal silica had been added to the furnish. The comparison was made at three different temperatures: 220, 250 and 270° C.

At 220° C. there were small bubbles due to delamination spread over the surface of the sheet produced without chemicals. No bubbles could be seen at the surface of the sheet containing polyacrylamide and silica.

At 250° C. the bubbles on the sheet produced without chemicals were much larger than at 220° C. For the sheet containing the nanoparticle system a few small bubbles could be seen at the sheet surface.

At 270° C. the bubbles on the sheet produced without chemicals had become very big in size. The bubbles on the sheet containing the nanoparticle system had increased a little in size as compared to 250° C.

The results obtained in this example show that addition of a chemical system of a polymer component in combination with micro- or nanoparticles as prescribed in the process according to the present invention can increase the critical temperature where delamination occurs in impulse pressing.

What is claimed is:

1. A process for the production of paper which comprises:

(i) forming an aqueous suspension containing cellulosic fibres, and optional fillers;

(ii) draining the suspension to form a paper web;

(iii) subjecting the obtained paper web to impulse pressing by passage through at least one press nip having at least one heated roll which is in contact with the paper web and heated to a temperature above 100° C.;

wherein at least one polymer and micro- or nanoparticles are added to the suspension or the paper web before the paper web passes the press nip.

2. The process of claim 1, wherein the polymer and micro- or nanoparticles are added to the suspension.

3. The process of claim 2, wherein a wet strength resin is also added to the suspension.

4. The process of claim 2, wherein a sizing agent is also added to the suspension.

5. The process of claim 1, wherein the polymer is a polysaccharide having one or more aromatic groups and one or more cationic groups.

6. The process of claim 1, wherein the micro- or nanoparticles are selected from the group consisting of anionic silica-based particles, anionic organic particles, anionic swelling clays, amphoteric aluminum hydroxide, polyaluminum salts and combinations thereof.

7. The process of claim 6, wherein the micro- or nanoparticles are anionic silica-based particles.

8. The process of claim 1, wherein the polymer is cationic or amphoteric starch, cationic or amphoteric guar gum, or cationic or amphoteric acrylamide-based polymer.

9. The process of claim 1, wherein the polymer is a cationic organic polymer having one or more aromatic groups.

10. The process of claim 1, wherein the roll in contact with the web is heated to a temperature within the range of from 150 to 350° C.

11. The process of claim 1, wherein the press nip contains the heated roll and a shoe.

12. The process of claim 1, wherein the press nip contains a pair of rolls.

13. The process of claim 1, wherein the paper web has a dry solids content within the range of from 30 to 45% prior to being contacted with the heated roll.

14. The process of claim 1, wherein the passage through the press nip increases the dry solids content of the paper web by at least 25%.

15. The process of claim 1, wherein the paper web is passed through two or more press nips in which each press nip has at least one heated roll.

16. The process of claim 1, wherein the paper web is dewatered by mechanical pressing before being subjected to impulse pressing.

17. The process of claim 1, wherein the paper web after impulse pressing is passed through a drying section of a paper machine.

18. A process for the production of paper which comprises:

(i) forming an aqueous suspension containing cellulosic fibers, and optional fillers;

(ii) adding to the suspension from 0.01 to 50 kg/tonne, based on dry cellulosic fibers and optional filler, of at least one organic polymer and from 0.01 to 10 kg/tonne, based on dry cellulosic fibers and optional filler, of silica-based particles;

(iii) draining the obtained suspension to form a paper web; and (iv) passing the paper web through one or more press nips having one or more heated rolls with a temperature above 100° C. wherein the paper web is contacted with said one or more heated rolls.

19. The process of claim 18, wherein the heated rolls have a temperature within the range of from 150 to 350° C.

20. The process of claim 18, wherein the paper web has a dry solids content within the range of from 30 to 45% prior to being contacted with the heated roll.

21. The process of claim 18, wherein the passage through the press nip increases the dry solids content of the paper web by at least 50%.

22. The process of claim 18, wherein the silica-based particles have a specific surface area within the range of from about 50 to about 1700 $m^2/g$.

23. The process of claim 18, wherein the silica-based particles have an average particle size from about 1 to about about 50 nm.

24. A process for the production of paper which comprises:

(i) forming an aqueous suspension containing cellulosic fibers, and optional fillers;

(ii) adding to the suspension from 0.01 to 50 kg/tonne, based on dry cellulosic fibers and optional filler, of at least one organic polymer and from 0.001 to 25 kg/tonne, based on dry cellulosic fibers and optional filler, of a micro- or nanoparticulate material;

(iii) dewatering the obtained suspension to form a paper web having a dry solids content within the range of from about 20 to about 70%; and (iv) contacting the obtained paper web with one or more heated rolls in a press nip, the rolls being heated to a temperature above 100° C.

25. The process of claim 24, wherein the paper web has a dry solids content within the range of from about 25 to about 50% before being contacted with the one or more heated rolls in the press nip.

26. The process of claim 24, wherein the paper web has a dry solids content within the range of from about 30 to about 45% before being contacted with the one or more heated rolls in the press nip.

27. The process of claim 24, wherein the heated rolls have a temperature within the range of from 150 to 350° C.

28. The process of claim 24, wherein the micro- or nanoparticulate material comprises silica-based particles.

29. The process of claim 28, wherein the silica-based particles have a specific surface area within the range of from about 50 to about 1700 $m^2/g$.

30. The process of claim 28, wherein the silica-based particles have an average particle size from about 1 to about about 50 nm.

* * * * *